US005842290A

United States Patent [19]

Mills

[11] Patent Number: 5,842,290

[45] Date of Patent: Dec. 1, 1998

[54] STEP-IN SHOE COVERS

[76] Inventor: James Douglas Mills, 2602 Oakwood Rd., Porter County, Valparaiso, Ind. 46383

[21] Appl. No.: 833,234

[22] Filed: Apr. 14, 1997

[51] Int. Cl.[6] ..... A43B 3/10

[52] U.S. Cl. ..... 36/7.5; 36/7.1 R; 36/7.5; 36/11.5

[58] Field of Search ..... 36/9 R, 9 A, 7.1 R, 36/7.5, 7.8, 11.5, 15, 100, 135

[56] References Cited

U.S. PATENT DOCUMENTS

| | | | |
|---|---|---|---|
| D. 94,348 | 1/1935 | Heilbrunn | 36/11.5 |
| 105,671 | 7/1870 | Gunn | 36/138 |
| D. 131,318 | 2/1942 | Levin | 36/11.5 |
| 259,781 | 6/1882 | Thomson | 36/138 |
| 900,881 | 10/1908 | Parker | 36/11.5 |
| 948,797 | 2/1910 | Smith | 36/7.3 |
| 1,187,778 | 6/1916 | Paskett | 36/7.5 |
| 1,250,852 | 12/1917 | Goldstone | 36/11.5 |
| 1,407,992 | 2/1922 | Doody | 36/11.5 |
| 1,447,586 | 3/1923 | Zucker | 36/7.3 |
| 1,894,561 | 1/1933 | Guiffre | 36/11.5 |
| 2,110,839 | 3/1938 | Ferriot | 36/11.5 |
| 2,220,534 | 11/1940 | McLean | 36/11.5 |
| 2,391,720 | 12/1945 | Ludwig | 36/11.5 |
| 2,408,564 | 10/1946 | Lea | 36/7.1 R |
| 2,513,005 | 6/1950 | Crawford | 36/11.5 |
| 2,901,840 | 9/1959 | Ferguson | 36/7.1 R |
| 3,040,451 | 6/1962 | Hilkemeyer | 36/7.5 |
| 3,283,423 | 11/1966 | Schovee | 36/7.3 |
| 3,621,592 | 11/1971 | Goldmerstein | 36/2.5 RY |
| 4,019,265 | 4/1977 | Epstein | 36/7.1 R |
| 4,896,439 | 1/1990 | Morgan | 36/7.5 |
| 5,056,240 | 10/1991 | Sherrill | 36/7.3 |

*Primary Examiner*—M. D. Patterson

*Attorney, Agent, or Firm*—Gary M. Hartman; Domenica N. S. Hartman

[57] ABSTRACT

A shoe cover (10) characterized by being removable and replaceable without requiring the use of the wearer's hands. The shoe cover (10) generally includes a sole (16) having a heel portion (18) and a toe portion (20), one or more members (30) for elastically pulling the toe portion (20) toward the heel portion (18), and a tab (32) projecting from the shoe cover (10) near the heel portion (18). As such, prior to donning, the shoe cover (10) is biased to have a slightly arcuate shape in the region of the sole (16) between the toe and heel portions (20, 18). When putting on the shoe cover (10), the intended wearer steps on the tab (32) near the heel portion (18) so as to immobilize the cover (10), and then inserts the toe of the other foot into the toe portion (20) of the shoe cover (10) to the extent that the shoe cover (10) is generally straightened, overcoming the tension generated by the elastic member (30). In so doing, the shoe cover (10) is able to accommodate the heel of the wearer's shoe, thereby allowing the shoe to be readily and completely received in the shoe cover (10). When the tab (32) is released, the elastic member (30) encourages the shoe cover (10) to return to its original arcuate shape, which serves to firmly grip the toe and heel regions of wearer's shoe and thereby reliably secure the shoe cover (10) to the shoe.

19 Claims, 2 Drawing Sheets

STEP-IN SHOE COVERS

BACKGROUND OF THE INVENTION

1. Field of the Invention

The present invention generally relates to foot wear. More particularly, this invention relates to a protective cover adapted to be worn over a shoe so as to cover the sole of the shoe, wherein the cover is configured to enable donning and removal of the cover without use of the wearer's hands.

2. Description of the Prior Art

Shoe covers are known in the art for providing a protective barrier between ones'shoes and the surface over which the wearer is walking. While a variety of conditions arise where shoe covers are useful, particularly notable examples are the frequent occasions where home repair or service is being performed in an area of a house that requires the repair or service personnel to walk across carpeting or a hardwood floor. Painters, HVAC repair personnel, and chimney cleaners are particularly apt to track dirt and, depending on circumstances, oil, paint, soot, etc., into a house when they reenter after retrieving supplies. In order to remain clean, shoe covers must be worn only within the house being serviced, necessitating that the shoe covers be repeatedly removed and replaced each time the personnel leave and reenter the house.

Various shoe covers have been proposed in the past for the applications noted above as well as other circumstances. An inexpensive shoe cover that has found use is similar to the "booties" required for hospitals and processing clean rooms. Shoe covers of this type have a cloth or paper construction with an elastic opening through which the shoe is inserted. While suitable for hospital conditions, these shoe covers do not hold up well under conditions encountered by repair and service personnel. Furthermore, several sizes may be required in order to accommodate various shoe sizes. Accordingly, while the individual price of this type of shoe cover may be relatively low, the cost of providing an ample supply to replace worn shoe covers of various sizes can be quite high.

Another drawback of the bootie-type shoe cover is that the cover must be donned with the use of at least one hand. While only a minor nuisance under some circumstances, repair and service personnel must often carry equipment and materials with them as they enter and leave a house. This, and the potential for personnel needing to leave and reenter a house numerous times, renders the bootie-type shoe cover considerably inconvenient.

In view of the above, more durable shoe covers have been proposed, one example being disclosed in U.S. Pat. No. 5,056,240 to Sherrill. While overcoming the disadvantages noted above for bootie-type shoe covers, Sherrill's shoe cover has minimal structure for securely retaining the cover on the wearer's shoe. Specifically, the heel of the wearer's shoe is not positively engaged by any portion of the shoe cover, with only a lip around the edge of the shoe cover heel being available to contact only a limited lower portion of the shoe heel. Consequently, Sherrill requires the presence of ridges on the interior surface of the sole of the shoe cover. Though providing improved gripping action, the ridges would not appear to compensate fully for the lack of positive securement around the heel of the wearer's shoe.

From the above, it can be seen that it would be desirable to provide a shoe cover that is more durable and more securely held on the wearer's shoe than that possible with shoe covers of the prior art, while also being readily donned and removed without requiring the use of the wearer's hands.

SUMMARY OF THE INVENTION

It is an object of this invention to provide a shoe cover to be worn over a shoe so as to cover the sole of the shoe, thereby preventing soiling of surfaces by dirt and contaminants that may be present on the sole.

It is another object of this invention that the shoe cover is configured to enable donning and removal of the cover without use of the wearer's hands.

It is a further object of this invention that the shoe cover securely engages both the toe and heel region of the wearer's shoes.

In accordance with a preferred embodiment of this invention, these and other objects and advantages are accomplished as follows.

According to the present invention, there is provided a shoe cover for providing a protective barrier between ones'shoes and the surface over which the wearer is walking. The shoe cover is characterized by being removable and replaceable without requiring the use of the wearer's hands, so as to enable a hands-free operation. Yet the shoe cover of this invention is also configured to securely grip the outer surfaces of the wearer's shoes, such that the shoe cover remains securely attached to the shoe almost without regard to the movements of the wearer.

The shoe cover of this invention generally includes a sole having a heel portion and a toe portion, one or more members for elastically pulling the toe portion toward the heel portion, and a tab projecting from the shoe cover near the heel portion. As such, prior to donning, the shoe cover is biased to have a slightly arcuate shape in the region of the sole between the toe and heel portions. Consequently, the exterior surface of the sole can be described as generally convex. When putting on the shoe cover, the intended wearer steps on the tab near the heel portion of the cover so as to immobilize the cover, and then inserts the toe of the other foot into the toe portion of the shoe cover to the extent that the shoe cover is generally straightened, overcoming the tension generated by the elastic member. In doing so, the shoe cover is able to accommodate the heel of the wearer's shoe, thereby allowing the shoe to be completely received in the shoe cover. When the tab is released, the elastic member causes the shoe cover to return to its original arcuate shape, which serves to firmly grip the toe and heel regions of wearer's shoe and thereby reliably secure the shoe cover to the shoe.

The above features are generally promoted by the presence of a heel wall projecting from the heel portion of the sole, and a toe wall projecting from the toe portion of the sole, with the elastic member being attached to the heel and toe walls so as to generate the desired arcuate shape for the shoe cover. The heel wall may extend from the heel region up into the region of the sole between the toe and heel portions to promote the gripping capability of the shoe cover. The heel wall may be formed by any number of wall segments that further promote its gripping action and/or enable the heel wall to be customized to the shape of the shoe heel. Similarly, the toe wall may be formed to arcuately extend toward the heel portion in order to more fully surround and grip the toe of the wearer's shoe. With this configuration, the elastic member can be releasably attached to the toe wall. A more custom fit around the toe can be promoted by providing a pair of toe sidewalls projecting from the toe portion, and then releasably attaching the toe wall to the toe sidewalls and releasably attaching the elastic member to the toe wall.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE PREFERRED EMBODIMENT

Figure 1:
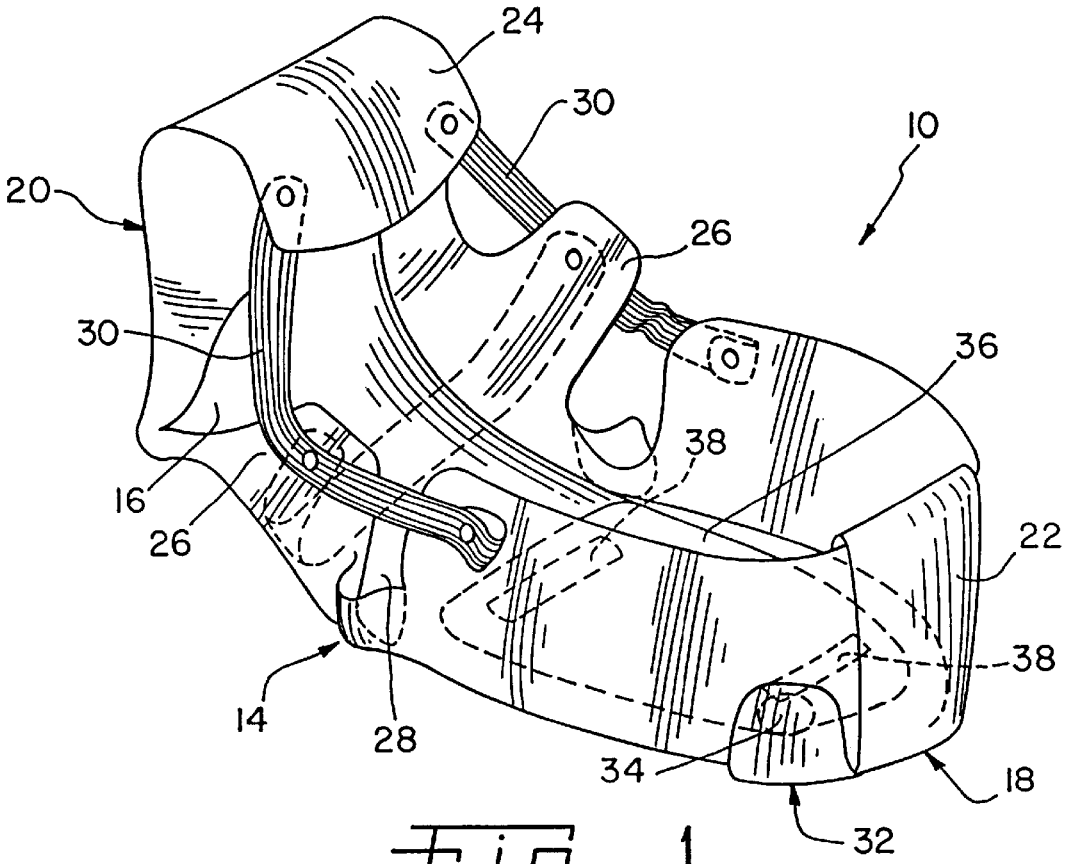
FIG. 1 shows a shoe cover in accordance with a first embodiment of this invention.
Figure 2:
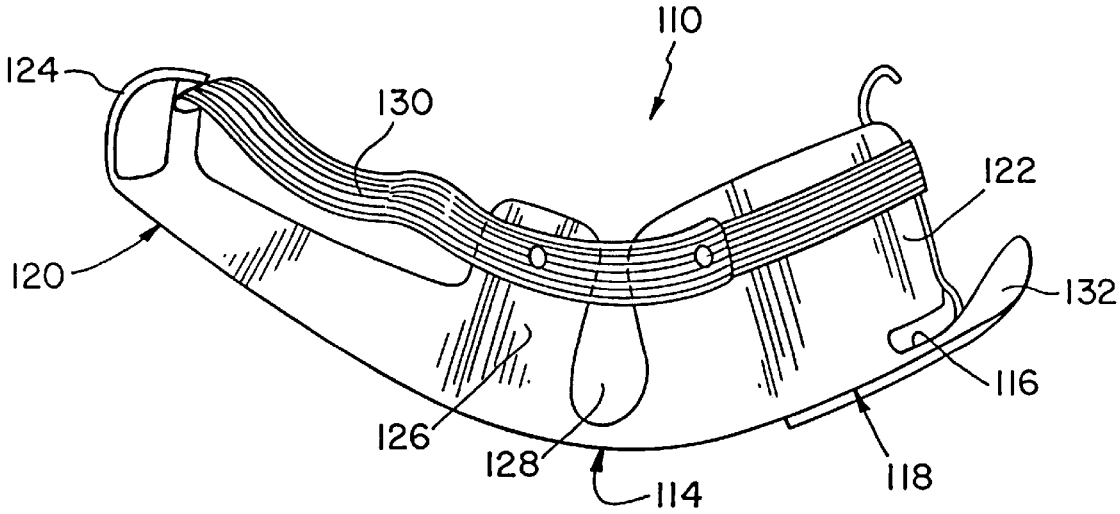
FIG. 2 is a side view of a shoe cover in accordance with a second embodiment of this invention.
Figure 3:
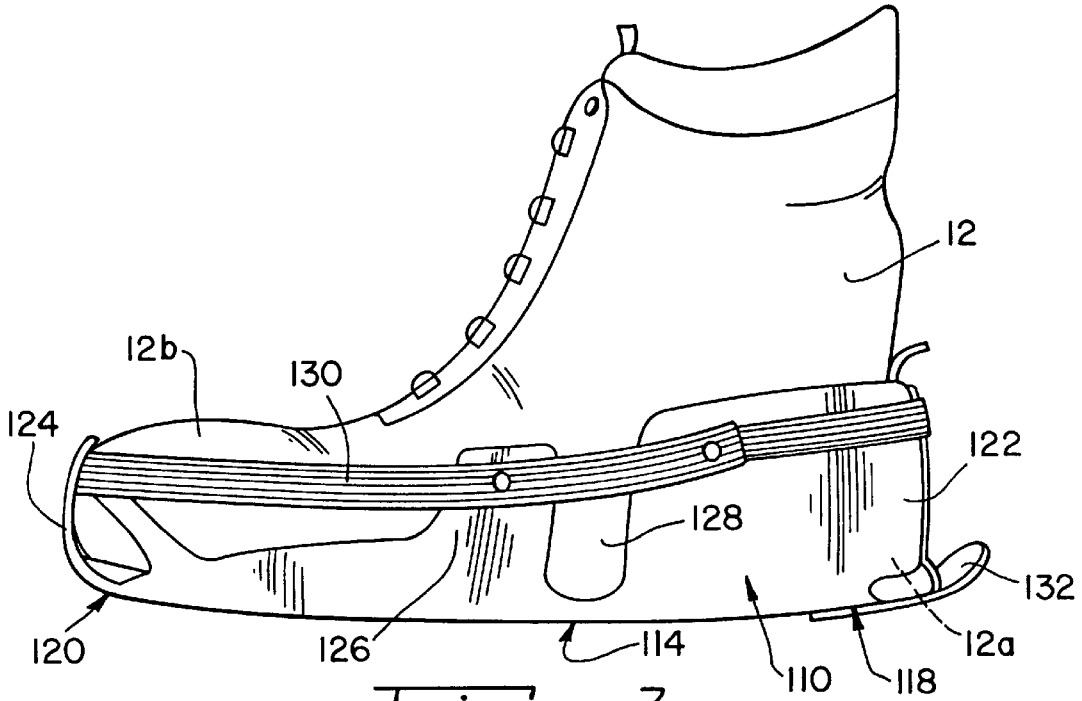
FIG. 3 is a side view of the shoe cover of FIG. 2 being worn over a shoe.
Figure 4:
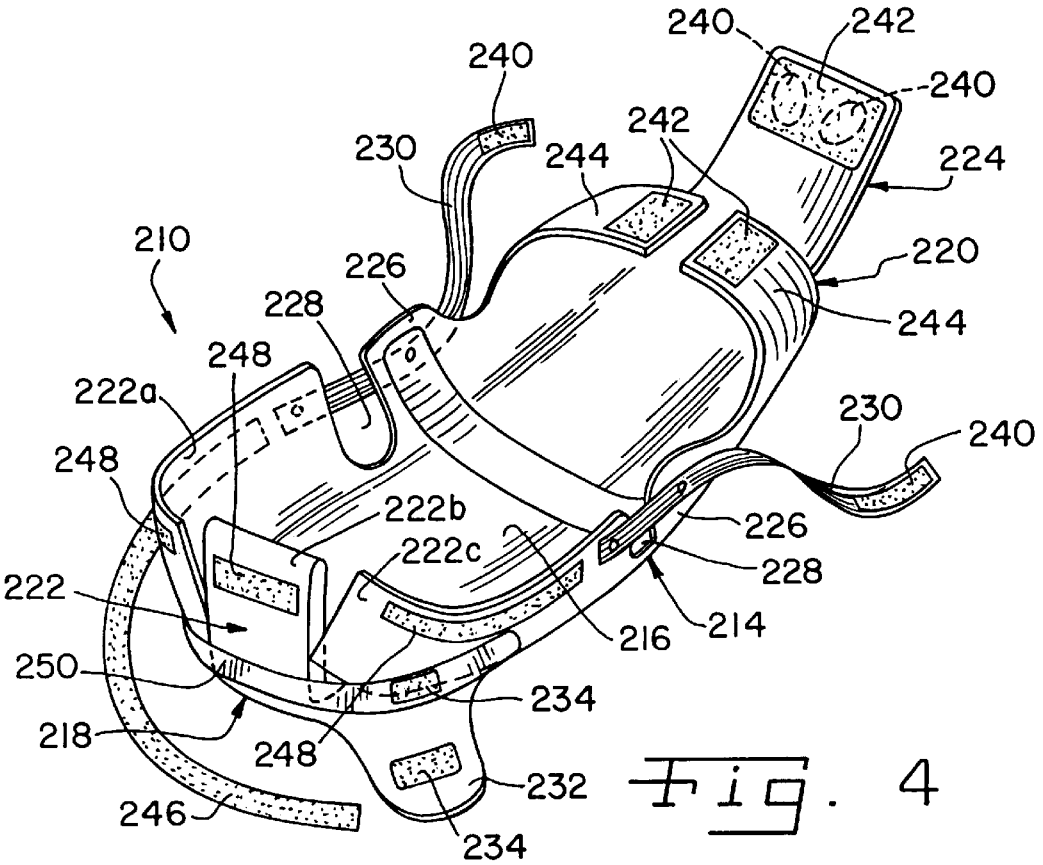
FIG. 4 shows a shoe cover in accordance with a third embodiment of this invention.

Shown in FIGS. 1 through 4 are three embodiments of shoe covers in accordance with this invention, each of which is adapted to be worn over a shoe, workboot or other footwear. With reference to FIG. 1, a first shoe cover 10 of this invention generally has a heel 18 and a toe 20. The terms "heel" and "toe" are used in the sense that, when the cover 10 is worn over a shoe (as shown in FIG. 3 with a shoe cover 110 in accordance with a second embodiment of the invention), the heel of the shoe is located at the heel 18 of the cover 10, and the toe of the shoe is adjacent the toe 20 of the cover 10. The heel 18 is shown as including a heel wall 22 that extends around the heel 18 toward a midportion 14 of the cover 10. The toe 20 has a toe wall 24 that arches back toward the heel 18 of the cover 10 as shown. The toe wall 24 need only extend rearwardly a distance sufficient to secure the toe of a shoe worn with the cover 10, as is apparent from FIG. 3. Between the heel and toe walls 22 and 24 are a pair of sidewalls 26 on opposite sides of the sole 16.

An important and distinct feature of the shoe cover 10 is the arcuate shape the cover 10 maintains in its free state, as the cover 10 is illustrated in FIG. 1. As depicted in this Figure, the arcuate shape of the shoe cover 10 is generally characterized by a localized bend in the midportion 14 of the cover 10, imparting a convex shape to the sole 16 of the shoe cover 10. Fastened to the heel wall 22, toe wall 24 and sidewalls 26 are a pair of elastic straps 30, which generate the arcuate shape of the shoe cover 10 by pulling the toe 20 back toward the heel 18 of the cover 10. To prevent total collapse of the cover 10, the material from which at least the sole 16 is formed must be relatively rigid. For this purpose, the sole 16 and preferably the heel wall, toe wall 24 and sidewalls 26 are all formed from a plastic such as vinyl, though other materials could foreseeably be used. The heel wall 22 and sidewalls 26 are shown as being spaced apart to yield a gap 28, which causes the elastic members 30 to localize the arcuate shape of the shoe cover 10 at the midportion 14. While this gap 28 could be relocated along the length of the cover 10 or eliminated completely, its presence is preferred in order to promote the flexibility of the shoe cover 10 at the midportion 14, which has been found to greatly facilitate donning of the cover 10 without use of the wearer's hands.

The shoe cover 10 is shown as having openings and gaps between the heel wall 22, toe wall 24, sidewalls 26 and straps 30 (e.g., gap 28). Closure of these openings and gaps is not necessary under many applications where coverage of the sole 16 is of primary importance. Nonetheless, for some applications it may be preferred that the entire interior of the cover 10 be lined with a flexible material, such as cloth or a thin plastic or rubber sheet, in order to close the openings. Alternatively, a flexible material could be selectively secured to cover only the openings and gaps. The benefit would be better retention within the cover 10 of debris, soil or contaminants that might have been adhering to the shoe prior to donning the cover 10. However, the flexible material should be chosen so as not to significantly affect the degree of rigidity desired for the shoe cover 10 in order to attain the arcuate shape induced by the straps 30.

While two separate elastic straps 30 are shown in FIG. 1, a single continuous strap 130 is shown for the shoe cover 110 of FIGS. 2 and 3. The strap 130 shown in FIGS. 2 and 3 completely encircles the shoe cover 110, thereby providing an additional and beneficial tensioning effect around the heel wall 122 and toe wall 124 of the cover 110, as can be appreciated from FIG. 3. Otherwise, the shoe cover 110 of FIGS. 2 and 3 is substantially similar to the cover 10 of FIG. 1, e.g., the shoe cover 110 has a midportion 114, sole 116, heel 118, toe 120, heel wall 122, toe wall 124, sidewalls 126, and gaps 128 between the heel wall 122 and sidewalls 126.

Notably, other tensioning elements could be substituted for the straps 30 and 130 shown in the Figures, including cords, bands and springs of any suitable material. Furthermore, it is foreseeable that any number of tensioning elements could be employed to achieve the arcuate shape of the shoe covers of this invention.

Because the straps 30 and 130 induce the arcuate shape in the shoe covers 10 and 110, otherwise rendering the shoe covers 10 and 110 difficult to don without use of the wearer's hands, the covers 10 and 110 further include tabs 32 and 132, respectively, extending rearwardly from their respective heels 18 and 18. With reference to FIG. 3, a wearer is able to insert his or her shoe 12 in the shoe cover 110 by stepping on the tab 132 so as to immobilize the cover 110, and then inserting the toe 12*b* of the shoe 12 into the toe 120 of the cover 110 to the extent that the shoe cover 110 is generally straightened, overcoming the tension generated by the elastic strap 130. In so doing, the shoe cover 110 is able to accommodate the heel 12*a* of the shoe 12, thereby allowing the shoe 12 to be readily and completely received in the shoe cover 110. When the tab 132 is released, the elastic strap 130 encourages the shoe cover 110 to return to its original arcuate shape, which serves to firmly grip the toe 12*b* and heel 12*a* of the wearer's shoe and thereby reliably secures the shoe cover 110 to the shoe 12.

The tab 132 of FIGS. 2 and 3 is shown as being separately formed and attached to the exterior surface of the sole 116 of the cover 110. In this embodiment, the thickness of the tab 132 can differ from the thickness of the sole 116, enabling the thickness of each of these features to be tailored for their particular function. In contrast, the tab 32 shown in FIG. 1 is integrally formed with the sole 16 of the cover 10. Furthermore, the tab 32 is depicted as being folded against the heel wall 22 of the cover 10 in a stowed position. For this purpose, complementary patches 34 of a hook-and-loop material (e.g., VELCRO) or another releasable fastener are attached to the heel wall 22 and tab 32. The tab 32 can then be readily deployed by releasing the tab 32.

An optional feature shown in FIG. 1 and omitted from FIGS. 2 and 3 is a sponge pad 36 attached to the interior surface of the sole 16. As with the tab 32, the pad 36 is preferably releasably attached to the sole 16 with complementary patches 38 of hook-and-loop fasteners. The pad 36 serves to help retain moisture within the shoe cover 120 that might be present on the wearer's shoe. The ability to quickly remove the pad 36 enables any moisture in the pad 36 to be readily eliminated by squeezing, and further enables the pad 36 to be readily washed and replaced as necessary.

A shoe cover 210 in accordance with the third embodiment of this invention is shown in FIG. 3. Functionally, this shoe cover 210 is similar to those of FIGS. 1 through 3, but include modifications to allow the cover 210 to more readily accommodate shoes of different sizes. Similar to the covers 10 and 110, the shoe cover 210 is configured to include a midportion 214, a sole 216, heel 218, toe 220, heel wall 222, toe wall 224, sidewalls 226, and gaps 228 between the heel wall 222 and sidewalls 226. Similar to the cover 10 of FIG. 1, the shoe cover 210 of FIG. 3 employs a tab 232 that can be stowed with complementary patches 234 of hook-and-loop fasteners. As with the cover 10, the cover 210 also utilizes two elastic straps 230, one on each side of the cover 210 and adapted to interconnect the heel wall 222, sidewalls 226 and toe wall 224. However, the straps 230 of the shoe cover 210 are not permanently attached to the toe wall 224, but instead are releasably attached to the toe wall 224 with patches 240 of a hook-and-loop fastener provided near the ends of the straps 230 and on the topside of the toe wall 224. The shoe cover 210 further includes a pair of toe sidewalls 244 on either side of the toe wall 224. The underside of the toe wall 224 and the topsides of the toe sidewalls 244 are provided with complementary patches 242 of hook-and-loop fasteners. Finally, the heel 222 of the shoe cover 210 is shown as being formed by three segments 222*a*, 222*b* and 222*c*, the lower ends of which are retained by a reinforcing lip 250 that can be integrally formed with the sole 216. The three segments 222*a*, 222*b* and 222*c* are adapted to be tied together with a strap 246 and releasable fastener patches 248, again preferably of the complementary hook-and-loop type though other releasable fastener systems could be used.

With the configuration described above, the shoe cover 210 can be more closely fit to a particular shoe shape and size. For example, the intended wearer can insert a shoe into the shoe cover 210, fasten the toe wall 224 and toe sidewalls 244 to closely but slidably fit the toe of the shoe, and then pull the strap 246 sufficiently tight around the heel segments 222*a*, 222*b* and 222*c* to ensure a close fit around the heel of the shoe. According to this invention, even with a closer fit to a shoe, the shoe cover 210 can be readily donned and removed due to the arcuate shape of the cover 210 in its free state, induced by the elastic straps 230. Again, the arcuate shape of the cover 210 will have a localized bend in the midportion 214 due to the presence of the gaps 228 between the heel wall 222 and sidewalls 226. While footwear having the illustrated arcuate shape would typically be avoided as awkward to don, the shoe cover 210 of this embodiment (as with the covers 10 and 110 of the first two embodiments) utilize this configuration to enable the cover 210 to be quickly donned by holding the heel 218 with the tab 132 while pressing the toe 220 downward with the toe of the shoe to be covered, thereby straightening the cover 210 to the extent that the shoe can be readily inserted into the cover 210. Once the tab 232 is released, the straps 230 draw the heel and toe 218 and 220 toward each other, thus securing the cover 210 in place.

While the invention has been described in terms of a preferred embodiment, it is apparent that other forms could be adopted by one skilled in the art. For example, appropriate materials could be substituted for those noted, and the overall appearance of the shoe cover could differ from that shown. In addition, the shoe covers could be worn outdoors in snow and mud with little or only nominal modifications. Accordingly, the scope of the invention is to be limited only by the following claims.

What is claimed is:

1. A shoe cover comprising:

a sole formed of a relatively rigid plastic material and having a heel portion and a toe portion;

means permanently attached to both the toe portion and the heel portion for elastically pulling the toe portion toward the heel portion such that the sole is permanently and continuously biased to have an arcuate shape in a region of the sole between the toe and heel portions; and a tab projecting from the shoe cover in near the heel portion.

2. A shoe cover as recited in claim 1, wherein the sole has an exterior surface, the exterior surface being convex as a result of the sole having an arcuate shape.

3. A shoe cover as recited in claim 1, further comprising a first wall projecting from the heel portion of the sole, and a second wall projecting from the toe portion of the sole.

4. A shoe cover as recited in claim 3, wherein the pulling means is attached to the first and second walls.

5. A shoe cover as recited in claim 3, further comprising a side wall projecting from the region of the sole between the toe and heel portions.

6. A shoe cover as recited in claim 5, wherein the pulling means is attached to the first wall, the side wall and the second wall.

7. A shoe cover as recited in claim 3, wherein the first wall extends from the heel region up to the region between the toe and heel portions.

8. A shoe cover as recited in claim 3, further comprising a pair of side walls projecting from the region of the sole between the toe and heel portions, the pair of side walls being oppositely-disposed on the sole.

9. A shoe cover as recited in claim 8, wherein the pulling means comprises:

a first elastic member permanently attached to the first wall, one of the side walls, and the second wall so as to permanently and continuously bias the first wall, the one of the side walls and the second wall toward each other; and a second elastic member permanently attached to the first wall, a second of the side walls, and the second wall so as to permanently and continuously bias the first wall, the second of the side walls and the second wall toward each other.

10. A shoe cover as recited in claim 1, further comprising:

a heel wall projecting from the heel portion, the heel wall comprising multiple wall segments; and means for releasably securing the multiple wall segments together.

11. A shoe cover as recited in claim 1, further comprising a toe wall projecting from the toe portion, the toe wall arcuately extending toward the heel portion.

12. A shoe cover as recited in claim 11, further comprising a pair of toe sidewalls projecting from the toe portion, the toe wall being between the pair of toe sidewalls.

13. A shoe cover as recited in claim 12, wherein the toe wall is releasably attached to the toe sidewalls and the pulling means is releasably attached to the toe wall.

14. A shoe cover as recited in claim 1, wherein the tab projects from the heel portion of the sole.

15. A shoe cover as recited in claim 1, further comprising a wall projecting from the heel portion, and means for releasably securing the tab to the wall

16. A shoe cover as recited in claim 1, further comprising a cushion releasably attached to the heel portion.

17. A shoe cover comprising:

a sole formed of a relatively rigid plastic material and having a heel portion, a toe portion, and a midportion between the heel and toe portions;

a heel wall projecting from the heel portion of the sole;

a toe wall projecting from the toe portion of the sole;

a pair of side walls projecting from the sole between the heel wall and the toe wall, the pair of side walls being oppositely-disposed on the sole, the side walls and heel wall forming a gap therebetween;

a tab projecting from the sole at the heel portion; and elastic means permanently attached to each of the toe wall, the side walls, and the heel wall, the elastic means elastically pulling the toe portion toward the heel portion such that the sole is permanently and continuously biased to have an arcuate shape between the toe and heel portions and to have a localized bend at the midportion corresponding to the gap between the heel wall and the side wall.

18. A shoe cover as recited in claim 17, wherein the heel wall comprising multiple wall segments, the shoe cover further comprising means for releasably securing the multiple wall segments together.

19. A shoe cover as recited in claim 17, wherein the toe wall arcuately extends towards the heel portion, the shoe cover further comprising a pair of toe sidewalls projecting from the toe portion, the toe wall being between the pair of toe sidewalls, the toe wall being releasably attached to the toe sidewalls, the elastic means being releasably attached to the toe wall.

* * * * *